US009482061B2

(12) United States Patent
Latimer et al.

(10) Patent No.: US 9,482,061 B2
(45) Date of Patent: Nov. 1, 2016

(54) SUBSEA CONNECTOR ASSEMBLY

(71) Applicant: FLEXIBLE ENGINEERED SOLUTIONS LIMITED, Ashington (GB)

(72) Inventors: Ian Latimer, Morpeth (GB); Michael Stanton, Rothbury (GB); Richard Pattison, Choppington (GB)

(73) Assignee: FLEXIBLE ENGINEERED SOLUTIONS LIMITED, Ashington (GB)

( * ) Notice: Subject to any disclaimer, the term of this patent is extended or adjusted under 35 U.S.C. 154(b) by 0 days.

(21) Appl. No.: 14/652,996

(22) PCT Filed: Oct. 31, 2013

(86) PCT No.: PCT/GB2013/052847

§ 371 (c)(1),
(2) Date: Jun. 17, 2015

(87) PCT Pub. No.: WO2014/096767

PCT Pub. Date: Jun. 26, 2014

(65) Prior Publication Data

US 2015/0337607 A1 Nov. 26, 2015

(30) Foreign Application Priority Data

Dec. 17, 2012 (GB) ..... 1222690.8

(51) Int. Cl.
*E21B 17/01* (2006.01)
*E21B 17/046* (2006.01)
(Continued)

(52) U.S. Cl.
CPC ..... *E21B 17/046* (2013.01); *E21B 17/01* (2013.01); *E21B 17/017* (2013.01); *E21B 17/02* (2013.01); *E21B 19/004* (2013.01); *E21B 43/0107* (2013.01)

(58) Field of Classification Search
CPC .... E21B 17/01; E21B 17/046; E21B 19/004; E21B 43/0107
USPC ..... 166/345, 367
See application file for complete search history.

(56) References Cited

U.S. PATENT DOCUMENTS 4,808,034 A * 2/1989 Birch ..... B63B 27/24 166/367
5,947,642 A * 9/1999 Teixeira ..... E21B 19/004 166/340

(Continued)

FOREIGN PATENT DOCUMENTS

FR 2934883 A1 2/2010
WO WO-9823845 A1 6/1998
WO WO-2012156320 A1 11/2012

OTHER PUBLICATIONS

Schouten, Adri, "International Search Report," prepared for PCT/GB2013/052847, as mailed Oct. 24, 2014, four pages.

*Primary Examiner* — Matthew R Buck
(74) *Attorney, Agent, or Firm* — Winstead PC

(57) ABSTRACT

A subsea connector assembly is provided for automatically coupling a movable subsea structure to a tubular fixed subsea structure. The connector assembly comprises a male connector assembly, removably mountable to the movable subsea structure, and further comprising a throughbore, at least one first actuator member and at least one second actuator member. The connector assembly further comprises an adapter assembly, removably mountable to an end-fitting of a string of tubulars, comprising at least one first engagement member and at least one second engagement member, each of said at least one first and second engagement member are operable to be acted upon by said first and/or second actuator member so as to selectively release a locked engagement with said male connector assembly, allowing said adapter assembly to be moved through said throughbore of said male connector assembly.

17 Claims, 19 Drawing Sheets

(51) Int. Cl.

| | |
|---|---|
| ***E21B 17/02*** | (2006.01) |
| ***E21B 19/00*** | (2006.01) |
| ***E21B 43/01*** | (2006.01) |

(56) References Cited

U.S. PATENT DOCUMENTS 8,016,520 B2 * 9/2011 Dybvik ..... B63B 21/50 114/293
8,196,666 B2 * 6/2012 Askestad ..... E21B 19/004 166/338
8,573,305 B2 * 11/2013 Reddy ..... E21B 17/017 166/338
8,939,214 B2 * 1/2015 Litherland ..... E21B 17/015 166/343
2010/0133811 A1 * 6/2010 Taylor ..... E21B 17/017 285/313
2011/0162747 A1 * 7/2011 Routeau ..... E21B 17/017 138/106
2012/0168172 A1 * 7/2012 Litherland ..... E21B 17/015 166/367
2014/0212221 A1 * 7/2014 Routeau ..... E21B 43/0107 405/168.1

* cited by examiner

SUBSEA CONNECTOR ASSEMBLY

The present invention relates generally to the field of subsea pipelines and manifolds, and in particular, to the field of subsea fluid connections of flexible pipes or umbilical to a fixed structure including devices for limiting the bend of the flexible pipes or umbilicals. More particularly, the invention relates to a connector assembly allowing interventionless installation of marine equipment such as, for example, a bend-stiffener.

INTRODUCTION

In subsea operations, it is often required to connect a string of tubulars such as, for example, flexible pipes, flowlines or umbilicals to a fixed structure, such as an offshore floating platform or a vessel. A string of tubulars is hereinafter referred to as a "riser". The riser may include cabling or control lines for equipment on the seafloor, so that they can be controlled remotely from the surface structure (i.e. the platform or vessel). Thus, risers are conduits for transferring hydrocarbon production fluids, such as, crude oil or gases to and from the surface.

FIG. 1 shows a typical setup for subsea operation, where production fluid is transferred from at least one subsea well 10 to a floating production, storage and offloading unit 20, also referred to as FPSO. A flexible riser 30 is used to transports the production fluid from the well 10, or a seabed production field in case of multiple wells, to the FPSO 20 via turret 40. Bend stiffeners 50 (only one connection is shown in FIG. 1) are typically used where the flexible riser 30 joins the fixed structure (i.e. where the flexible riser 30 enters the turret 40 through an 'I'- or 'J' tube 60), in order to protect the flexible riser 30 from excessive cyclic bending due to movement that may be caused by waves, current or wind, or which may simply be caused by the movement of the FPSO 20.

Often, the bend stiffener 50 is installed to the 'I'- or 'J'-tube 60 via a releasable connector assembly 70. The releasable connector assembly 70 may comprises a male connector portion 72, fitted to the bend stiffener 50, and a female connector portion 74, fitted to the 'I'- or 'J'-tube 60. During installation, the male connector portion 72 is attached to the bend stiffener 50 and an end-fitting 32 of the riser 30 is located and attached to the male connector portion 72. In particular, the end-fitting 32 of the riser 30 is located inside the throughbore of the male connector portion 72 and locked into place by, for example, a cam device, a clamp mechanism 78, a latch- or other interlocking mechanisms (not shown). The attachment of the male connector portion 72 and the end-fitting 32 is typically completed in a workshop.

Once the equipment (i.e. riser, end-fitting, bend stiffener and male connector portion) has been moved subsea, it is moved towards and into connection with the female connector portion 74 using a wire line 80 that is attached to the end-fitting 32 of the riser 30. When the male connector portion 72 is located in the female connector portion 74, it is interlocked with the female connector portion 74 so as to form a secure connection. Typically, a latch cam is used to couple male and female connector portions 72 and 74. The riser 30 is then released from the engagement with the male connector portion 72 and drawn up and through the bend stiffener 50 and the 'I'- or 'J'-tube to be fixed into place at the FPSO 20.

The interlocking of the male and female connector portions, as well as, the release of the riser end-fitting 32 from the male connector portion 72 is conventionally done through external intervention using, for example, subsea divers 90 and/or a Remotely Operated Vehicles (ROV) 92. In particular, the diver 90 or ROV 92 may operate the latch-cam 76 to secure the male connector portion 72 to the female connector portion 74, and then release the clamp mechanism 78 that is fixating the riser end-fitting 32 to the male connector portion 72.

However, using subsea divers 90 or ROV's 92 to operate the connector assembly 70 is very time consuming and expensive. Also, using subsea divers 90 to operate the latch-cam 76 and/or the clamp mechanism 78 has certain risks and dangers, as well as, logistic challenges associated with people operating machinery in a subsea environment. Furthermore, using ROV's 92 or divers 90 is usually a relatively slow and tedious process, consequently increasing costs and the time spent to complete the operation.

Accordingly, it is an object of the present invention to provide a subsea connector assembly that is suitable to operatively couple a moveable subsea structure with a fixed structure without additional external intervention. More particularly, it is an object of the present invention to provide a connector assembly suitable to automatically install a bend stiffener or bend limiter to a fixed structure (e.g. FPSO) without the need of intervention from ROV's or subsea divers.

SUMMARY OF THE INVENTION

A preferred embodiment of the invention seek to overcome one or more of the disadvantages of the prior art.

According to a first embodiment of the present invention, there is provided a subsea connector assembly for automatically coupling a movable subsea structure to a tubular fixed subsea structure, comprising:

- a male connector assembly, removably mountable to the movable subsea structure, comprising a throughbore, at least one first actuator member and at least one second actuator member;
- an adapter assembly, removably mountable to an end-fitting of a string of tubulars, comprising at least one first engagement member and at least one second engagement member, each of said at least one first and second engagement member are operable to be acted upon by said first and/or second actuator member so as to selectively release a locked engagement with said male connector assembly, allowing said adapter assembly to be moved through said throughbore of said male connector assembly.

This provides the advantage that marine equipment, such as a bend stiffener, can be installed by simply engaging the actuator members with the engagement members. In particular, once the male connector assembly is fitted to, for example, a bend stiffener, the retro-fittable adapter assembly then allows the end-fitting of the flexible riser to be securely but releasably attached within the throughbore of the male connector assembly. When the male connector assembly, and attached bend stiffener and riser end-fitting, engages with the female connector, the first actuator member is automatically activated allowing the riser end-fitting to be moved longitudinally within the throughbore of the male connector portion to activate the at lease one second actuator and release the riser end-fitting out of engagement with the male connector assembly. Therefore, as soon as the bend stiffener is securely coupled to the fixed structure (i.e. 'I'-tube), the riser is automatically released to be moved up and through the connector assembly and into engagement with the fixed structure. No external intervention by a subsea diver and/or ROV is required during this operation, thus, saving considerable time and costs for installing marine equipment such as a bend stiffener.

Each of said at least one first and second engagement member may be operable to be acted upon by said at least one first and/or second actuator member so as to selectively lock an unlocked engagement with said male connector assembly, allowing said adapter assembly to fixatingly engage with said male connector assembly.

This provides the advantage that previously installed marine equipment, such as bend stiffeners, can be removed from its attachment with a fixed structure, by interactively engaging the engagement members of the adapter assembly, connected to the riser end-fitting, with the actuator members of the male connector assembly. The engagement members are brought into engagement with the actuator members through longitudinal movement of the attached adapter assembly within the throughbore of the male connector assembly. External intervention by subsea divers and/or ROV's is not required saving significant time and costs for such an operation.

Advantageously, the second actuator member may be operable by matingly interlock said male connector assembly with a corresponding female connector.

Preferably, the first actuator member may be a circumferential groove on an inner wall of said throughbore that is adapted to operatively engage with said at least one first and/or second engagement member. Advantageously, the groove is chamfered on its downhole side when in-situ.

This provides the advantage that the first engagement members and the first actuator member do not require a specific angular alignment to be operable. Therefore, correct function of the engagement between the first actuator member and the first engagement member is ensured in any angular position of the adapter assembly relative to the concentric male connector assembly.

The at least one second actuator member may be a pin slidingly arranged in an aperture through said male connector assembly, said aperture is positioned so as to coincide with said groove, allowing movement of said pin between a first pin position, where at least part of a proximal end portion of said pin projects out of said aperture past an outer male connector assembly wall, and a second pin position, where at least part of a distal end portion of said pin projects into said groove. Advantageously, the pin may be adapted to be indexed in any one of said first and second pin position via a first indexing mechanism.

Suitably, the at least one first engagement member is arranged circumferentially about an outer surface of said adapter assembly. In particular, if there are more than one engagement member (e.g. three), than the multiple engagement members are arranged circumferentially about the outer surface, preferably equidistant to each other. This provides the advantage of an axially symmetrical distribution of any forces acting on the multiple engagement members.

Advantageously, the at least one first engagement member may be spring biased radially outwardly from said adapter assembly.

The at least one first engagement member may be adapted to move between a first engaged position, where said at least one first engagement member projects into said groove, and a first disengaged position, where said at least one first engagement member is moved out of engagement with said groove. Advantageously, the at least one first engagement member may be adapted to be selectively locked in said first disengaged position via a second indexing mechanism. Even more advantageously, the second indexing mechanism may be lockable in a retracted position so as to prevent any engagement with said at least one first engagement means. Suitably, the at least one first engagement member may be adapted to be indexed in said first engaged position.

The at least one second engagement member may be arranged coplanar with said at least one first engagement member, said second engagement member may also be adapted to move between a second engaged position, where said at least one second engagement member projects into said groove, and a second disengaged position, where said second engagement member is moved out of engagement with said groove. Advantageously, the at least one second engagement member may be adapted to be indexed in said second engaged and disengaged position via a third indexing mechanism.

Furthermore, the male connector assembly may comprise a plurality of circumferentially arranged first and/or second actuator members, and wherein said adapter assembly may comprise a plurality of second engagement members operatively corresponding to said plurality of second actuator members. Advantageously, all of said plurality of second engagement members may be circumferentially alignable with corresponding said plurality of second actuator members.

This provides the advantage that each one of the plurality of engagement members can be aligned with and engaged by its corresponding second actuator member. In particular, this provides the further advantage of improved functionality and safety, since the second engagement members are only activated (e.g. released) when all of the actuator members are engages simultaneously.

Advantageously, the male connector assembly may be adapted to matingly interlock with a corresponding female connector via a latch mechanism located on the female connector.

BRIEF DESCRIPTION OF THE DRAWINGS

A preferred embodiment of the present invention will now be described, by way of example only and not in any limitative sense, with reference to the accompanying drawings, in which.

DETAILED DESCRIPTION OF THE PREFERRED EMBODIMENTS

In the context of this specification, terms such us "top" and "bottom", "uphole" and "downhole", and "upper" and "lower" refer to respective sides of the equipment when in situ, i.e. when the equipment is installed within the arrangement providing a connection between the FPSO and the subsea well/reservoir. In particular, the terms "top", "upper" and "uphole" refer to the side of the equipment directed towards the surface when in situ, the terms "bottom", "lower" and "downhole" refer to the side of the equipment directed towards the seabed or seafloor when in situ. In addition, the term "coupled" means either a direct or indirect connection between one or more objects or components. Also, in this specification the term "latching dog" or "dog" may be understood to mean a mechanical device suitable for holding, gripping and/or fastening, comprising a spike, bar, hook, deadbolt, pin or the like. The term "bend stiffener" may refer to any one of a bend-stiffener, -restrictor or -limiter. The terms "fixed structure", "turret", "I-tube" and "J-tube" may be used interchangeably. A "riser" is understood to mean any string of tubulars or umbilicals suitable to operatively connect the subsea well or any other seafloor equipment with the fixed structure, e.g. a FPSO vessel. The term "intervention-less" is understood to mean without intervention from an ROV, subsea divers or any other device operated subsea to install the equipment. The terms "connector assembly"/"connector" and "adapter assembly"/"adapter"/"adapter ring" may be used interchangeably.

Figure 1:
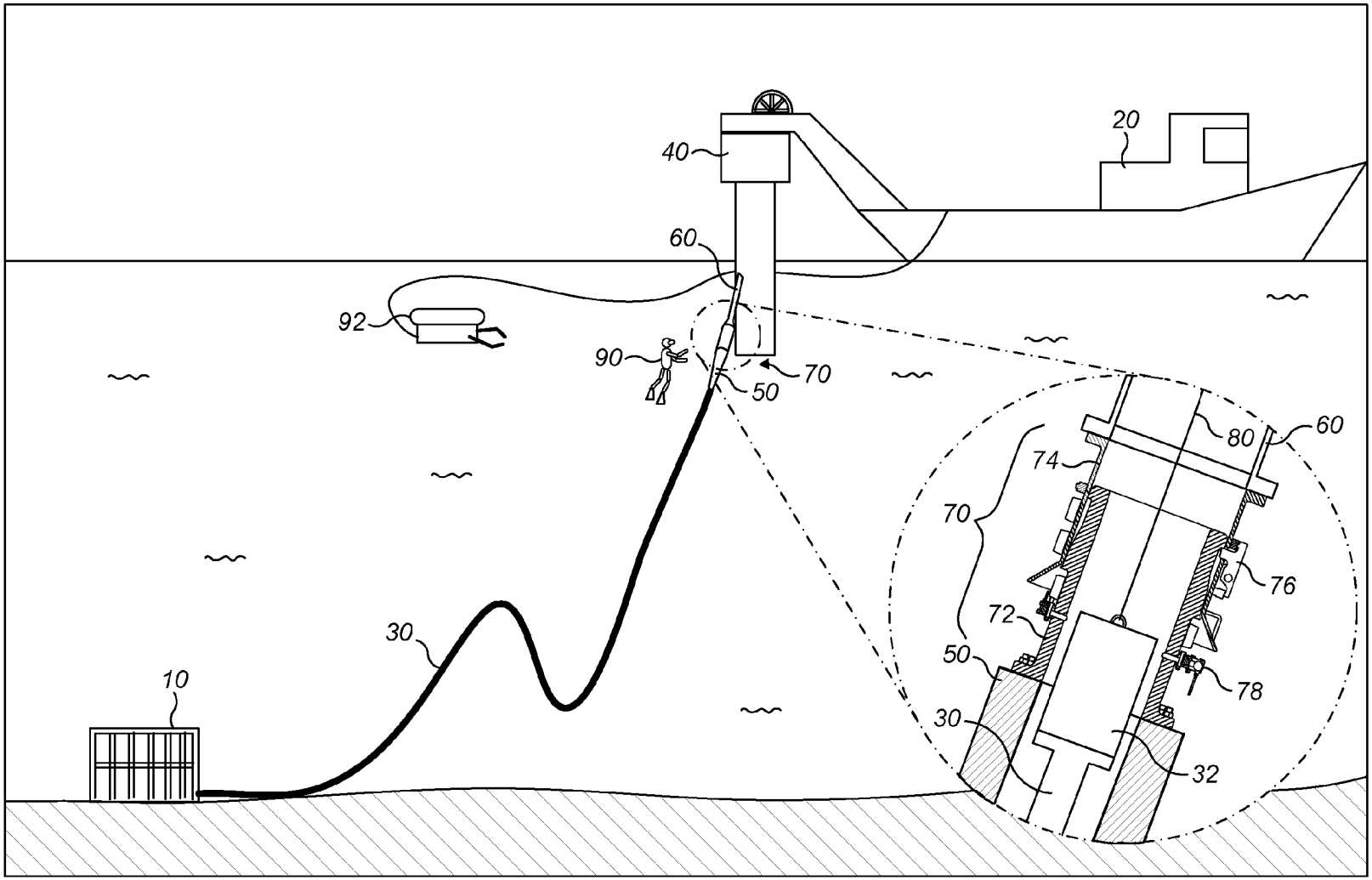
FIG. 1 (Prior Art)
FIG. 1 [Prior Art] shows an example of a typical offshore setup for producing hydrocarbons from a subsea well and transferring the fluids to and from a FPSO via a flexible riser, wherein the riser is protected by a bend stiffener at the point of entering an 'I'-'J'-tube of the FPSO.
Figure 2:
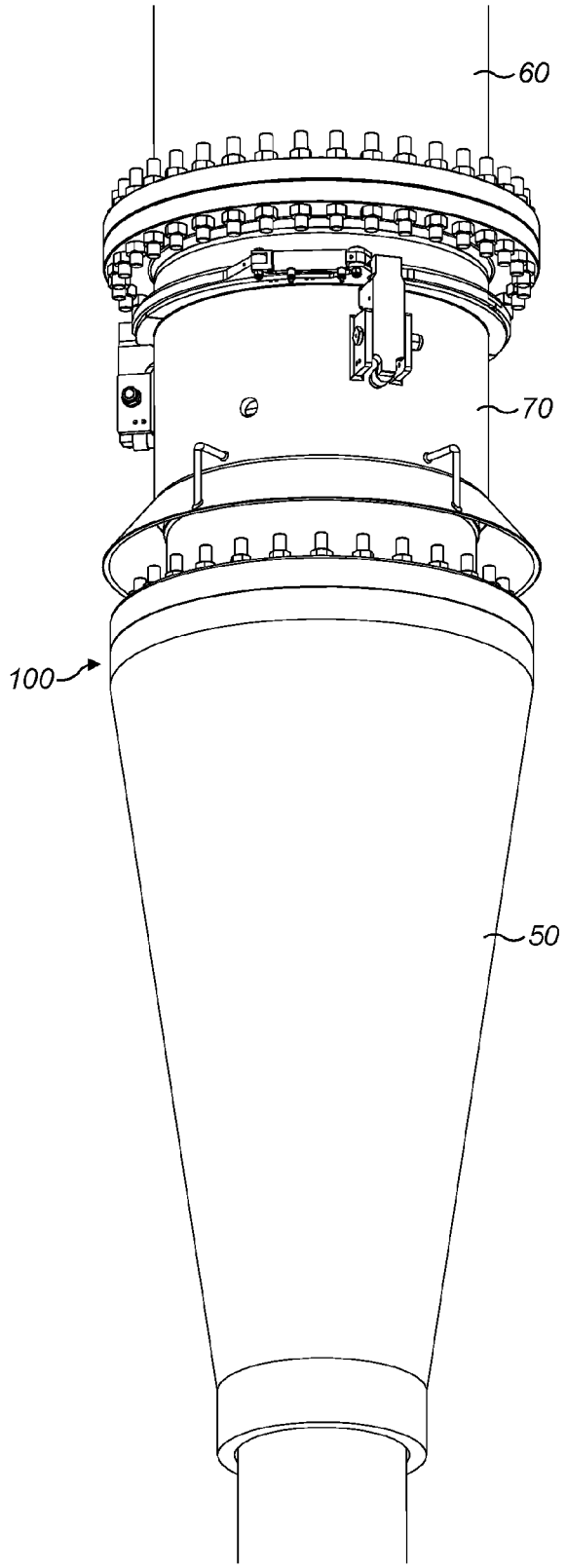
FIG. 2 shows an example of a bend stiffener when coupled to a suitable female connector assembly mounted to an 'I'-tube using the connector assembly of the present invention.
Figure 3A:
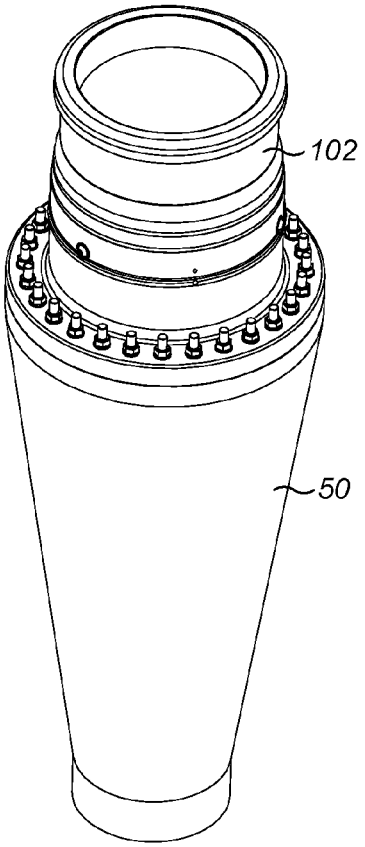
FIG. 3 shows a perspective view of (a) the bend stiffener and the attached male connector assembly, (b) a riser end-fitting with an attached adapter assembly and (c) a female connector assembly suitable to be coupled with the connector assembly of the present invention.
Figure 3B:
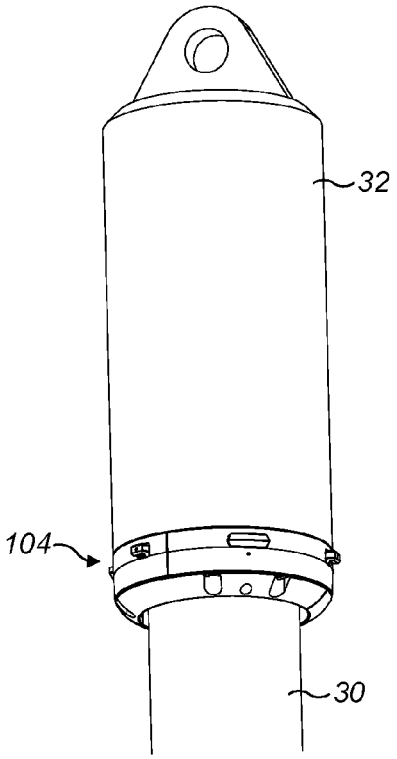
Figure 3C:
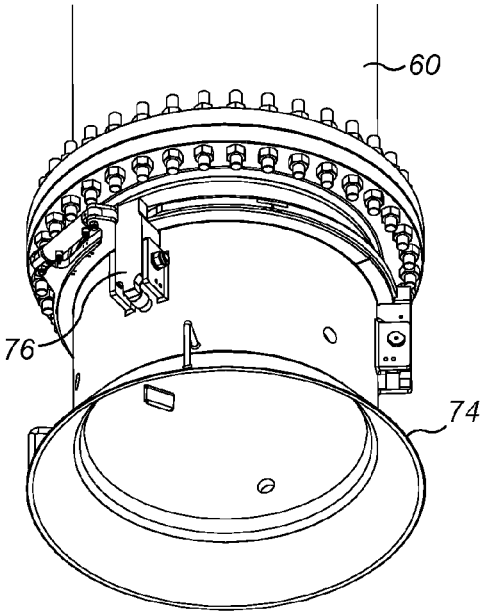

Referring now to FIG. 2, a preferred embodiment of the present invention is shown. In particular, a fully assembled bend stiffener 50 is coupled to a female connector 74 of an 'I'-tube 60 utilizing the connector assembly 100 of the present invention. FIGS. 3(*a*)-(*c*) show each of the main assembled parts separately. In particular, a male connector 102 is mounted to the top end of a typical bend stiffener 50, an adapter assembly 104 is mounted to the lower end of a riser end-fitting 32, and a typical female connector 74, having a latch mechanism 76 is mounted to an 'I'-tube. The female connector 74 is typically adapted to interlockingly receive the male connector 102.

Prior Assembly of the Riser/Male Connector and "Priming"

Before the bend stiffener 50 can be installed to the 'I'-tube subsea, the male connector 102 and end-fitting adapter 104 have to be mounted to the bend stiffener 50 and the riser end-fitting 32, respectively. This assembly is usually completed by technicians on the FPSO 20.

Figure 4B:
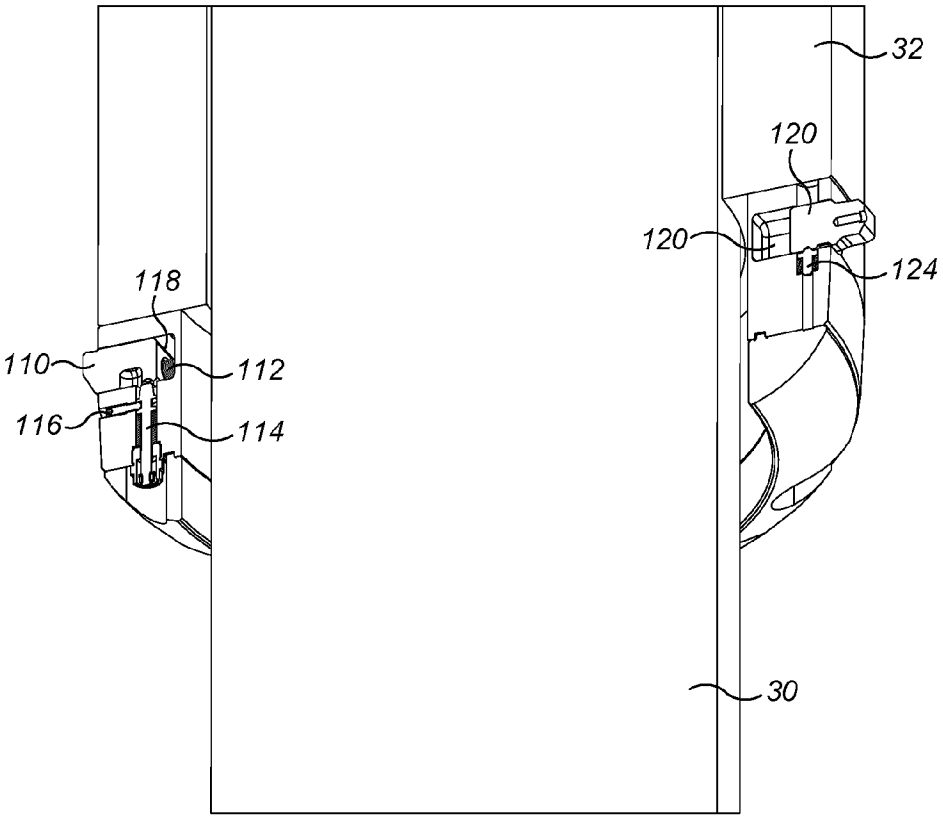
FIG. 4 shows (a) a perspective exploded view of the riser end-fitting and the adapter assembly before it is assembled and (b) a cross section of the riser end-fitting and the attached adapter assembly.
Figure 4A:
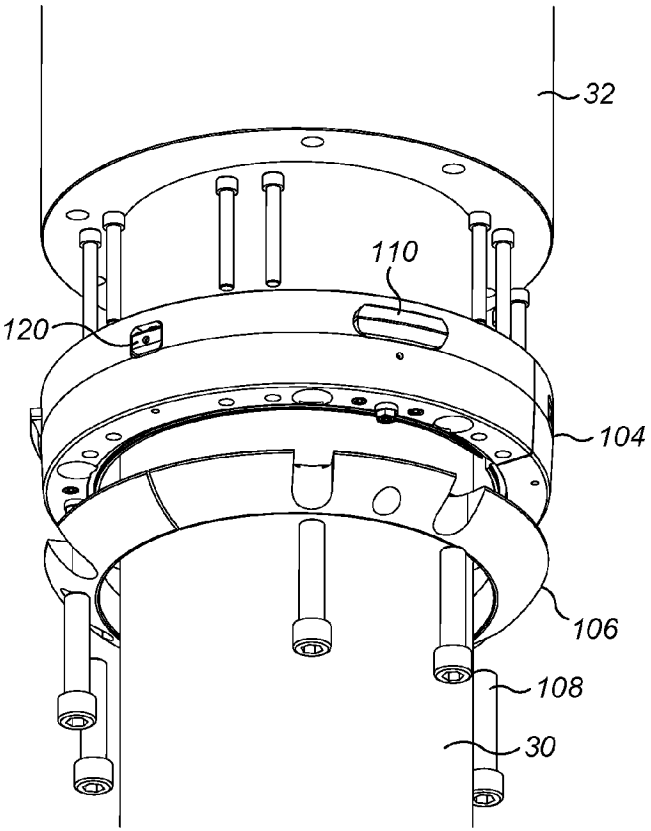

As shown in FIG. 4(*a*) and as shown in detail in FIG. 4(*b*), the adapter ring 104 is slid over the riser 30 to the bottom end of the riser end-fitting 32 and fixed to the end-fitting 32 utilizing a mounting ring 106 and mounting bolts 108. In this particular example, the adapter 104 includes three primary collets 110 that are installed within recesses 118 arranged circumferentially equidistant about the outer surface of the adapter ring 104. The primary collets 110 are slidable within the recesses 118 and spring biased in a radially outward direction by stacked conical washers 112. A lower edge of the protruding primary collets 110 is suitably chamfered, wherein the protruding part of top edge provides a flat surface. A locking pin 114 is adapted to index the primary collet 110 in a first position, where at least part of the primary collet 110 protrudes out of the outer surface of the adapter ring 104, and lock the primary collet 110 in a second position, where the primary collet 110 is fully retracted in the adapter ring 104. The locking pin 114 is spring biased in a direction towards the primary collet 110, and can be locked when the primary collet 110 is in its second position via a locking pin retaining grub screw 116.

The adapter assembly 104 further includes three secondary collets 120 installed within suitable recesses 122 that are arranged circumferentially equidistant between the primary collets 110 about the outer surface of the adapter ring 104. An indexing pin 124 is adapted to index the secondary collet 120 in a first position, where at least part of the secondary collet 120 protrudes out of the outer surface of the adapter ring 104, and a second position, where the secondary collet 120 is fully retracted in the adapter ring 104. The indexing pin 124 is spring biased towards the secondary collet 120.

It is understood by the skilled person in the art that any suitable number of primary and secondary collets 110, 120, and any suitable biasing means for the primary collets 110, as well as, the indexing pins 124 and locking pins 114 may be used with the adapter assembly 104.

Figure 5B:
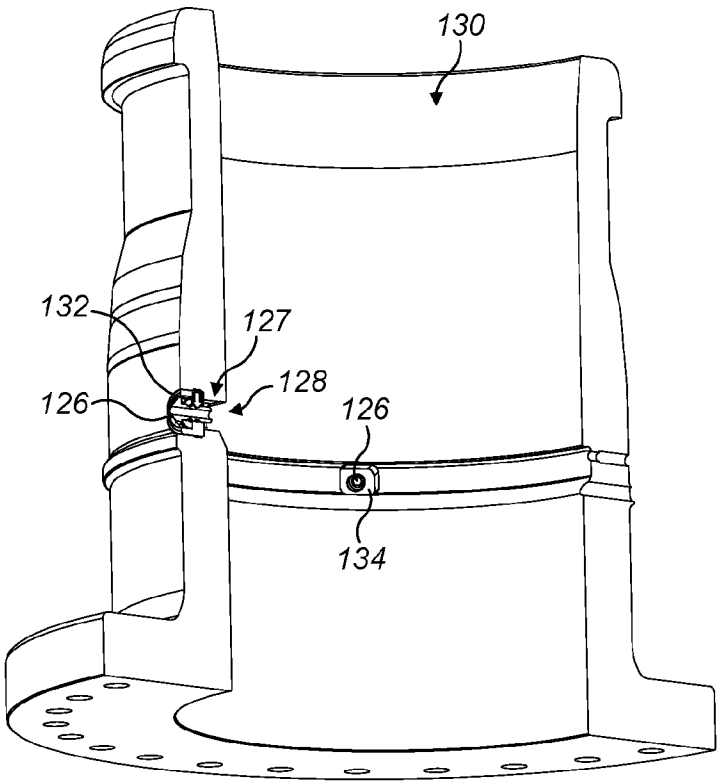
FIG. 5 shows (a) a perspective view and (b) a perspective sectional view of the male connector assembly before it is mounted to the bend stiffener.
Figure 5A:
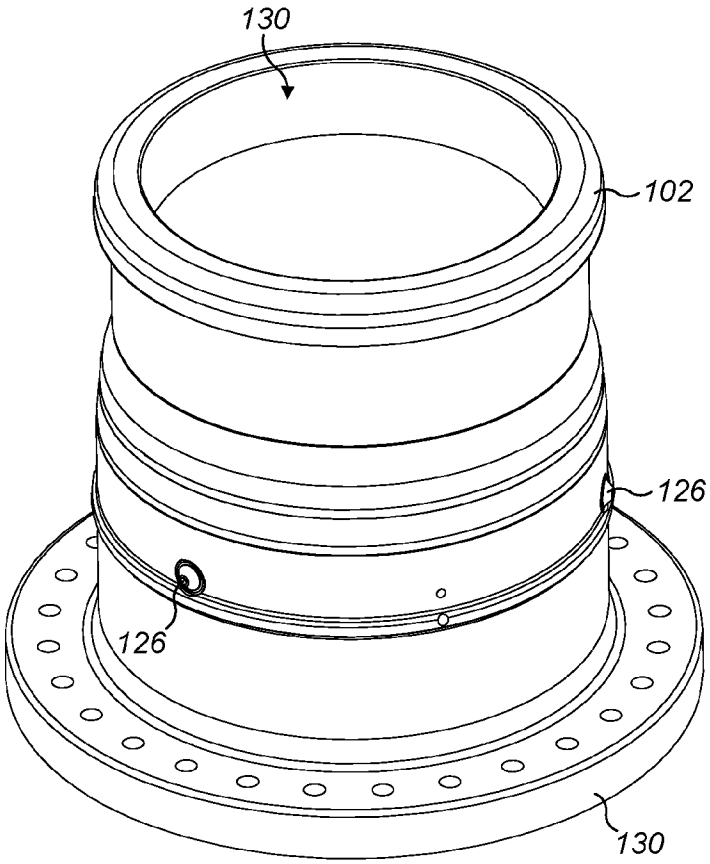
Figure 6B:
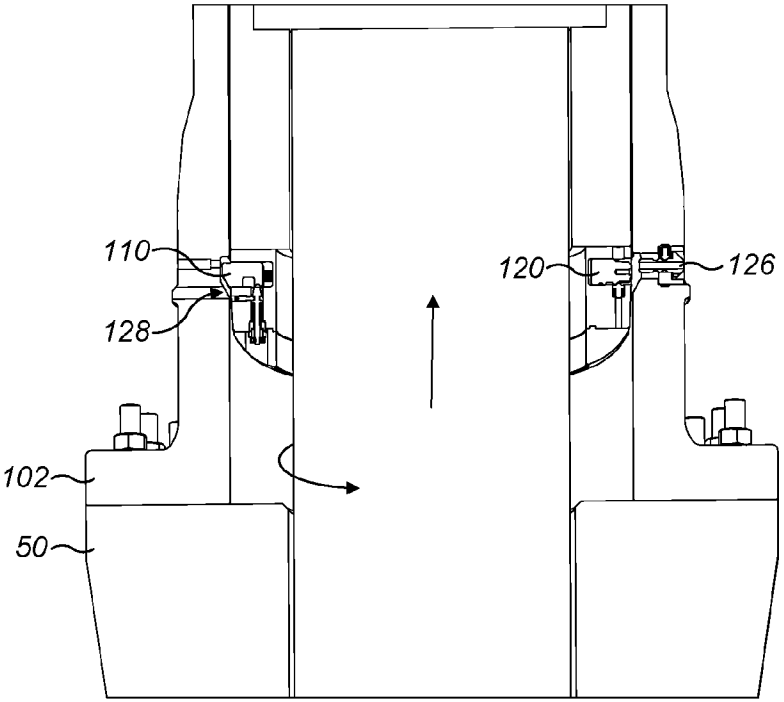
FIG. 6 shows a perspective sectional view of the male connector assembly (a) when the riser end-fitting is lowered into the throughbore of the male connector assembly and (b) when the first engagement members are in engagement with the first actuator member (groove) and the riser end-fitting is then moved about a longitudinal axis to rotationally aligned the second engagement members with corresponding second actuator members.
Figure 6A:
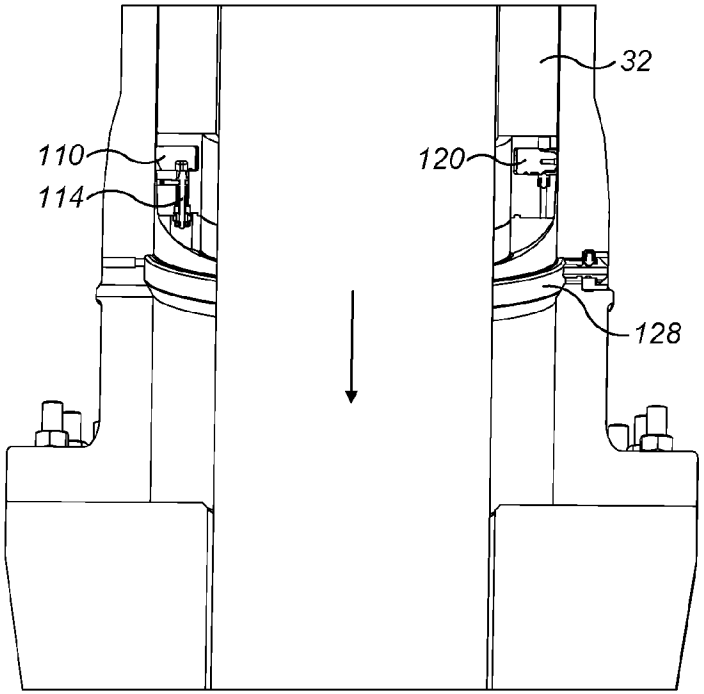
Figure 7B:
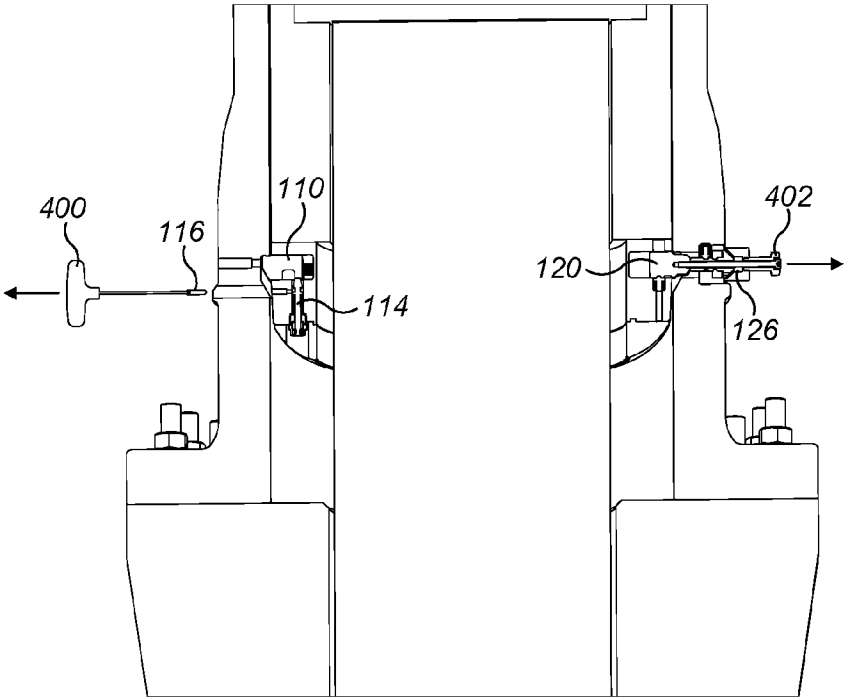
FIG. 7 shows a perspective sectional view of the male connector assembly (a) when first and second engagement member tools are placed and (b) used to move the first and second engagement members into the "primed" position.
Figure 7A:
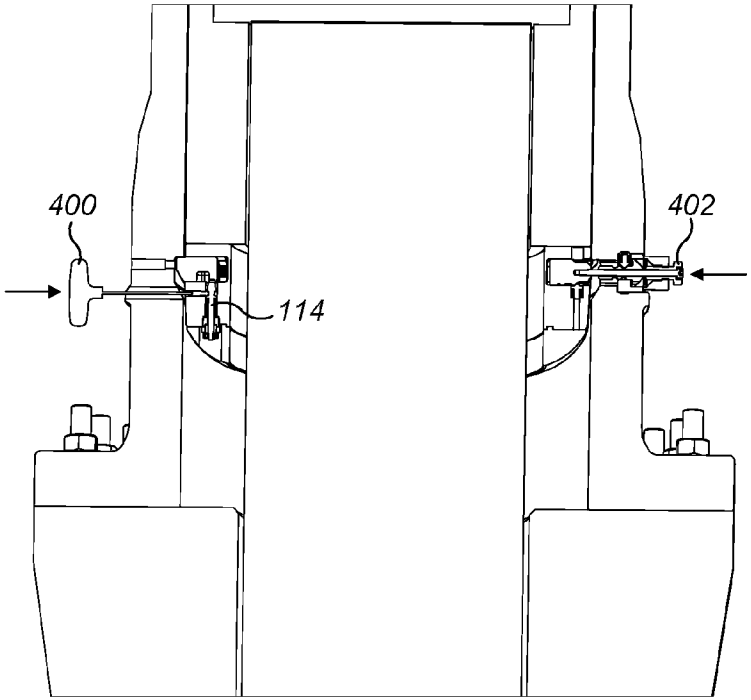

A close up view of the male connector 102 and a cross section through the male connector 102 is shown in FIGS. 5 (*a*) and (*b*). The male connector 102 has a flange portion 103 configured to be coupled with the top end of a bend stiffener 50. The profile of the outer surface of the male connector 102 is a typical "Diverless Bend Stiffener Connector" (DBSC) profile suitable to engage and interlock with a corresponding female connector 74 having a latching mechanism 76. The male connector 102 further comprises three poppets 126 slidingly mounted in apertures arranged 127 at a lower midsection and circumferentially equidistant about the outer surface of the male connector 102.

A circumferential groove 128 is arranged at the inner surface of a throughbore 130 of the male connector 102 so as to intersect with the apertures 127 of the poppets 126. The groove 128 has a lower edge 130 that is chamfered to matingly engage with the lower edge of the protruding primary collet 110. The upper edge of the groove 128 is substantially horizontal and flat.

A poppet indexing pin 132 is arranged to index the poppet 126 in a first position, where at least part of the poppet 126 projects out of the outer surface of the male connector 102, and a second position, where at least part of the poppet 126 projects into the groove 128. When the poppet 126 is in the second position, it does not protrude past the outer surface of the male connector 102.

In addition, secondary collet retaining slots 134 are arranged in the groove 128 around each of the poppets 126 and apertures 127. The secondary collet retaining slots 134 are configured to receive the protruding part of the secondary collets 120.

Before sliding the male connector 102 over the riser end-fitting 32, the secondary collets 120 are indexed in the second position, wherein the locking pin 114 is locked in a retracted position by the retaining grub screw 116 so as to not engage with the primary collet 110. The primary collets 110 are therefore urged radially outwards by the stacked conical washers 112. When sliding the riser end-fitting 32 into the throughbore 130 of the male connector 102, the primary collets 110 are pushed back through the engaging chamfered lower edge and snap out when engaging with the groove 128. The attached riser end-fitting 32 is then lifted back up and the secondary collets 120 are rotationally aligned with respective secondary collets retaining slots 134 and poppets 126.

Once the secondary collets 120 are aligned, a hex T-bar 400 is used to remove the retaining grub screw 116 and release the locking pin 114 to be urged towards and index the primary collet 110 into its first position. A setting tool 402 is then inserted into the secondary collet 120 used to pull and index the secondary collets 120 and poppets 126 into their respective first positions. Hex T-bar 400 and setting tool 402 are removed.

Figure 8A:
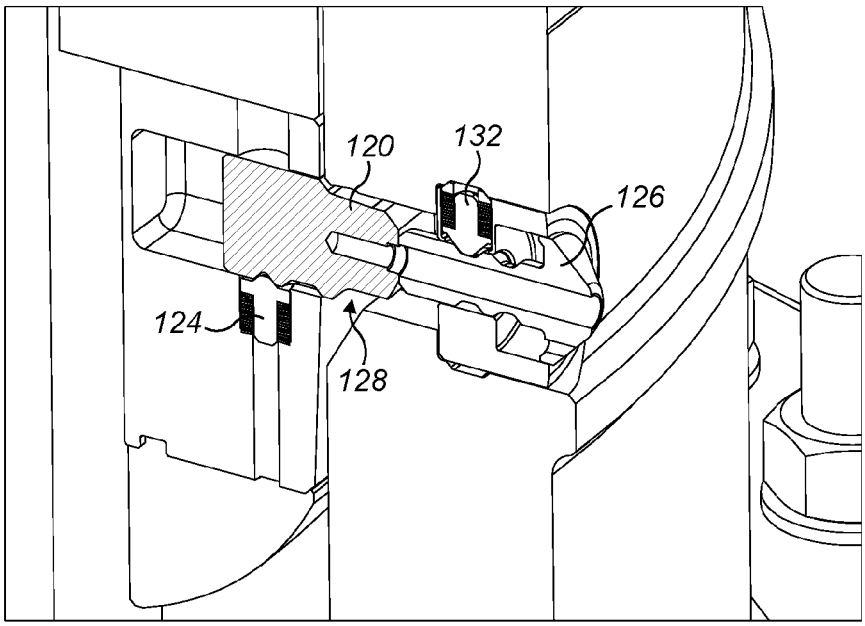
FIG. 8 shows a detailed perspective sectional view of (a) the second engagement member when in engagement with the first actuator member (groove) (the second actuator member (poppet) is indexed in the "primed" position), and (b) the first engagement member when in engagement with the first actuator member (groove) (the first engagement member is indexed in its "primed" position), so as to fixedly position the riser end-fitting within the male connector assembly.
Figure 8B:
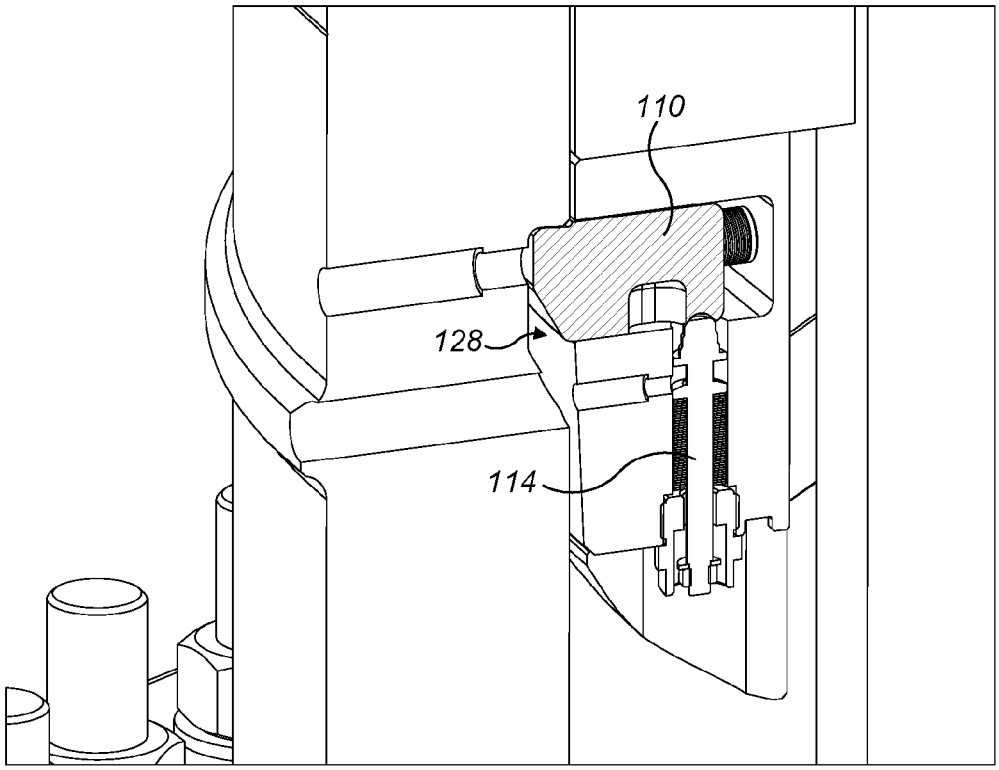
Figure 9B:
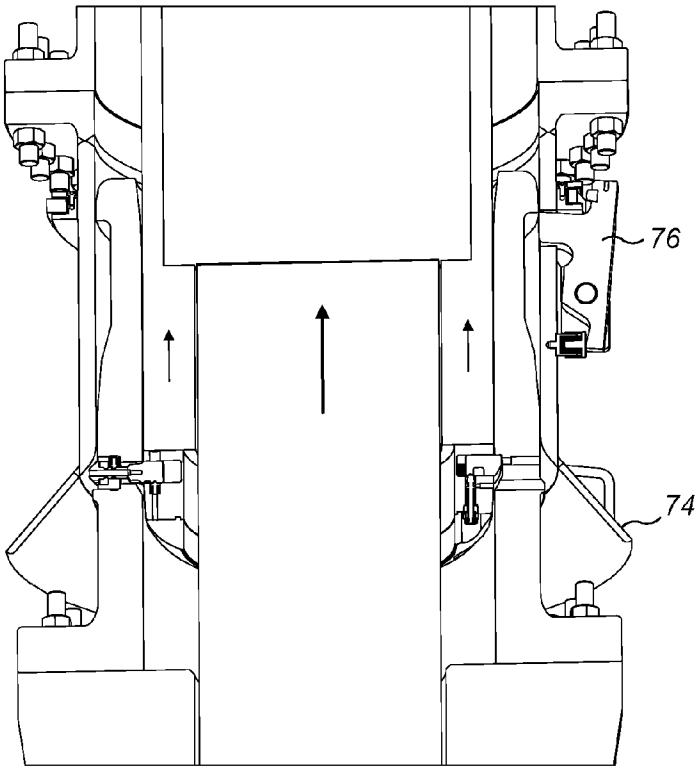
FIG. 9 shows a sequence of coupling the male connector assembly into corresponding female connector assembly (a) pulling male connector into the female connector, (b) moving passed the latch clamp of the female connector, (c) activating second actuator member (poppet) through engagement with the inner wall of the female connector and disengaging second engagement member with the first actuator member (groove), and (d) lowering the riser end-fitting within the throughbore of the male connector and interlocking the male connector with the female connector via the latch clamp.
Figure 9A:
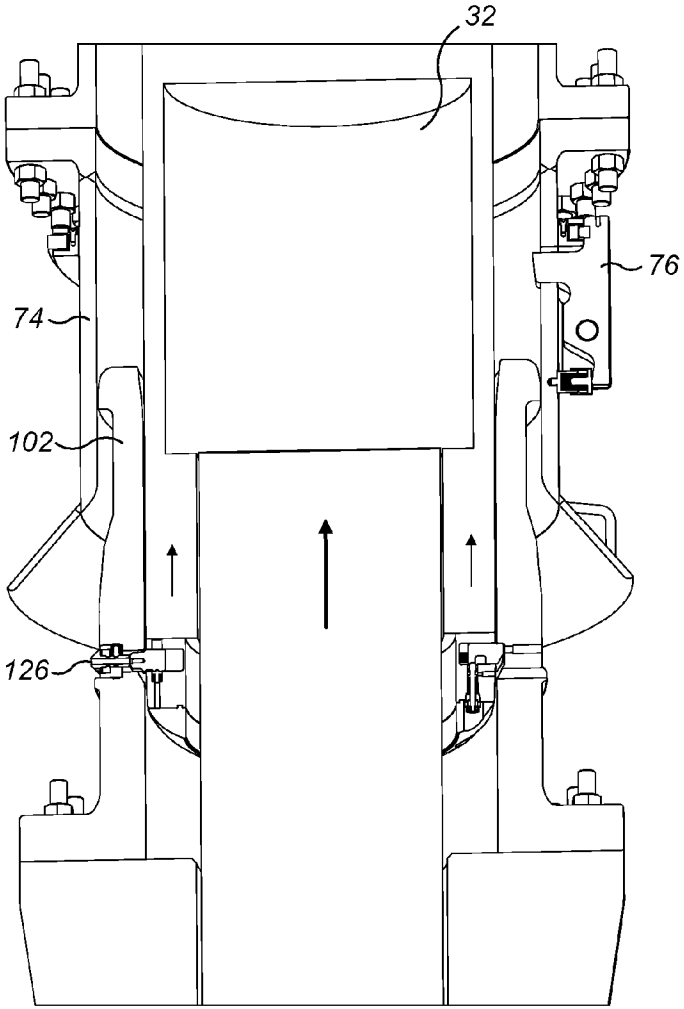
Figure 9D:
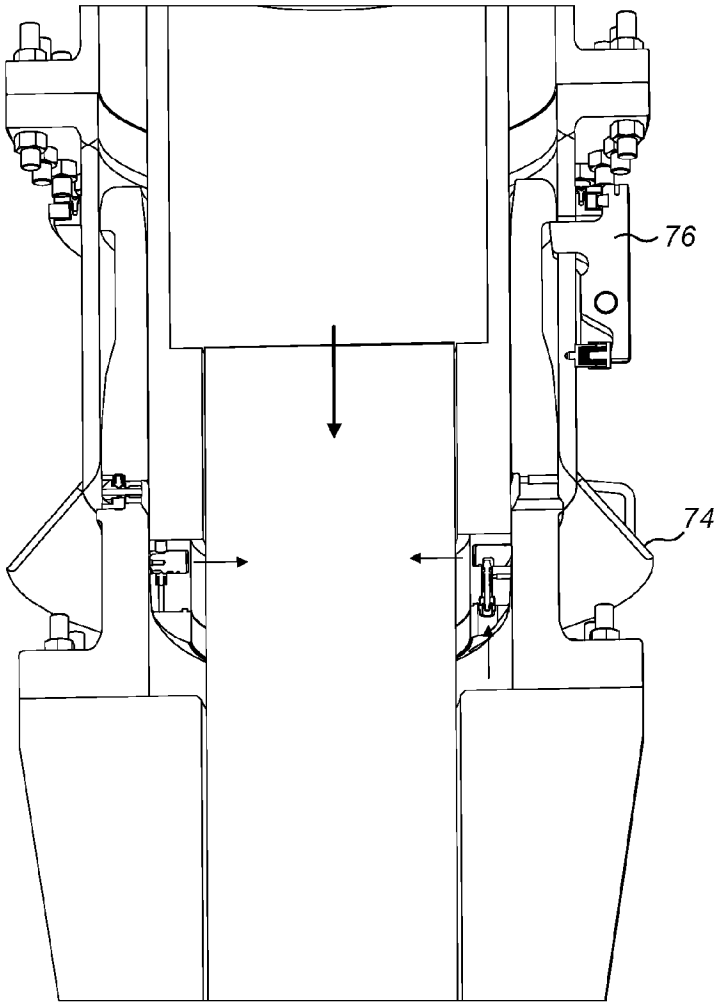
Figure 9C:
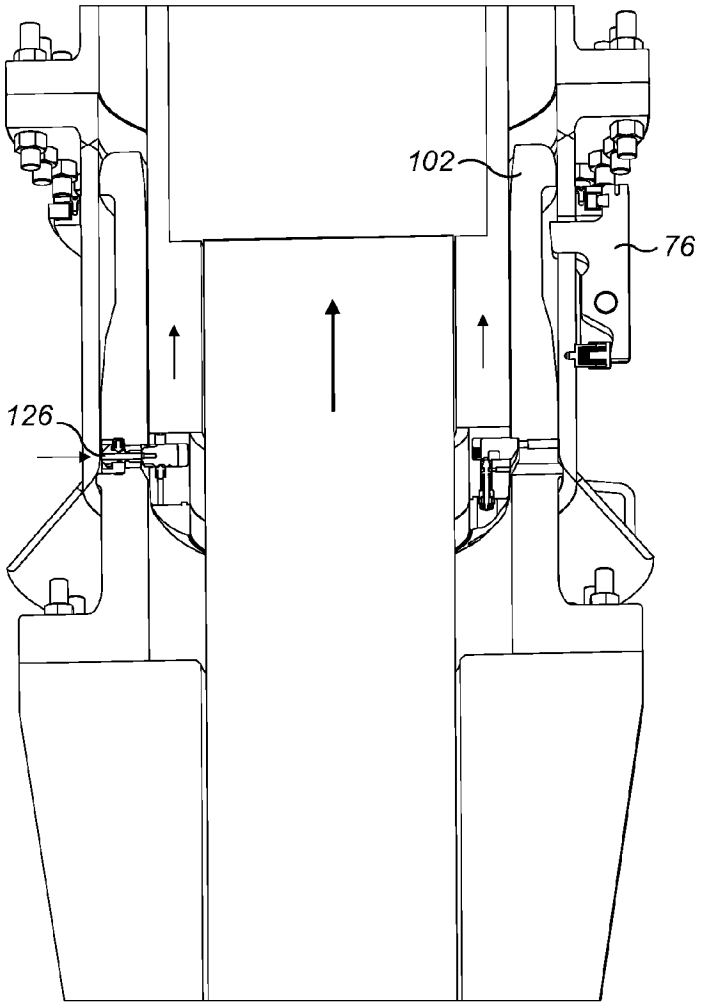

FIG. 8 (*a*) shows a detailed close-up view of a secondary collet 120 and respective poppet 126 when both are indexed in their first position. A small clearance is provided between the upper side of the protruding secondary collet 120 and the upper edge of the groove 128, and the lower side of the secondary collet 120 and the lower edge of the groove 128. FIG. 8 (*b*) shows a detailed close-up view of a primary collet 110 indexed in its first position by the now released locking pin 114. The primary collets 110 cannot be forced back into their respective recesses 118 unless all secondary collets 120 are pushed back by all the poppets 126.

The riser end-fitting 32 (as well as connected riser 30) and attached male connector 102 (as well as connected bend stiffener 50) are now "Primed" for subsea installment.

Subsea Installation of the Bend Stiffener

FIGS. 9 (*a*)-(*d*) show a sequence of a subsea installation of the bend stiffener 50. The "primed" riser end-fitting is first connected to a suitable wire line 80 (not shown) that is pulled in through the 'I'-tube 60 from the FPSO 20. The riser end-fitting 32 and attached male connector 102 are then pulled up (white and black arrows) into the female connector 74 so that the upper lip of the male connector 102 engages with the female latch mechanism 76 to move it back and let the male connector 102 pass. At the point where the female latch mechanism 76 is about to snap shut to retain the male connector 102 and interlock with the female connector 74, the poppets 126 are not yet in contact with the inner wall of the female connector 74. When the male connector is pulled past the female latch 76, all poppets 126 are forced into their second position indexing the secondary collets 120 into respective second positions (i.e. activated). The male connector 102 is then lowered onto the female latch 76 so that the riser end-fitting 32 continues to be lowered due to the weight of the riser 30. An optional shoulder (not shown) arranged within the throughbore 130 may be utilized to stop the downward movement of the riser end-fitting 32 at a predetermined location within the throughbore 130. Thus, when exiting the groove 128, both, primary and secondary collets 110, 120 are pushed back into respective recesses 118, 122. When the primary collets 110 are pushed back, the locking pin 114 automatically engages with the primary collet so as to lock it in the second position, i.e. the primary collet 110 cannot be moved back out without releasing the engagement with the locking pin 114. The secondary collets 120 are indexed in their second position clear of any engagement with the circumferential groove 128.

Figure 10B:
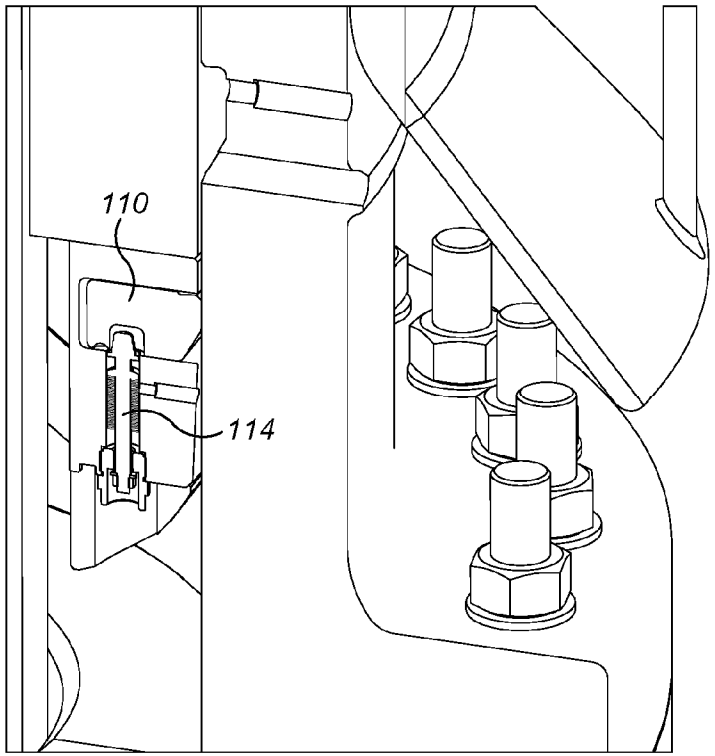
FIG. 10 shows a detailed perspective view of (a) the second engagement member and corresponding second actuator member (poppet), when the second actuator member (poppet) is indexed in its second "activated" position, and (b) the first engagement member when out of engagement with the first actuator member (grove) and locked in its first "disengaged" position.
Figure 10A:
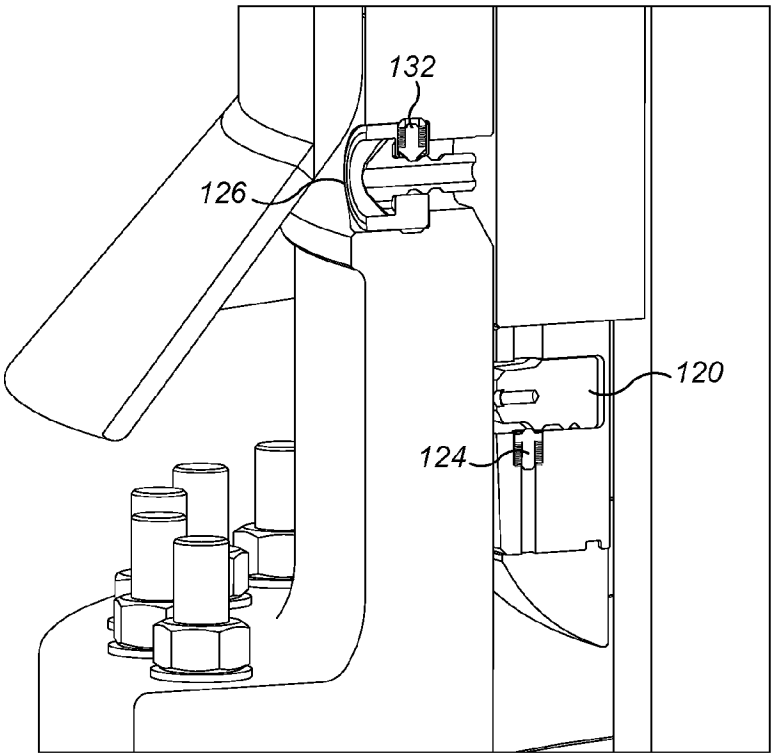

FIGS. 10 (*a*) and (*b*) show a detailed close-up view of a secondary and primary collet 120, 110 when respectively indexed and locked in the second position.

Figure 11B:
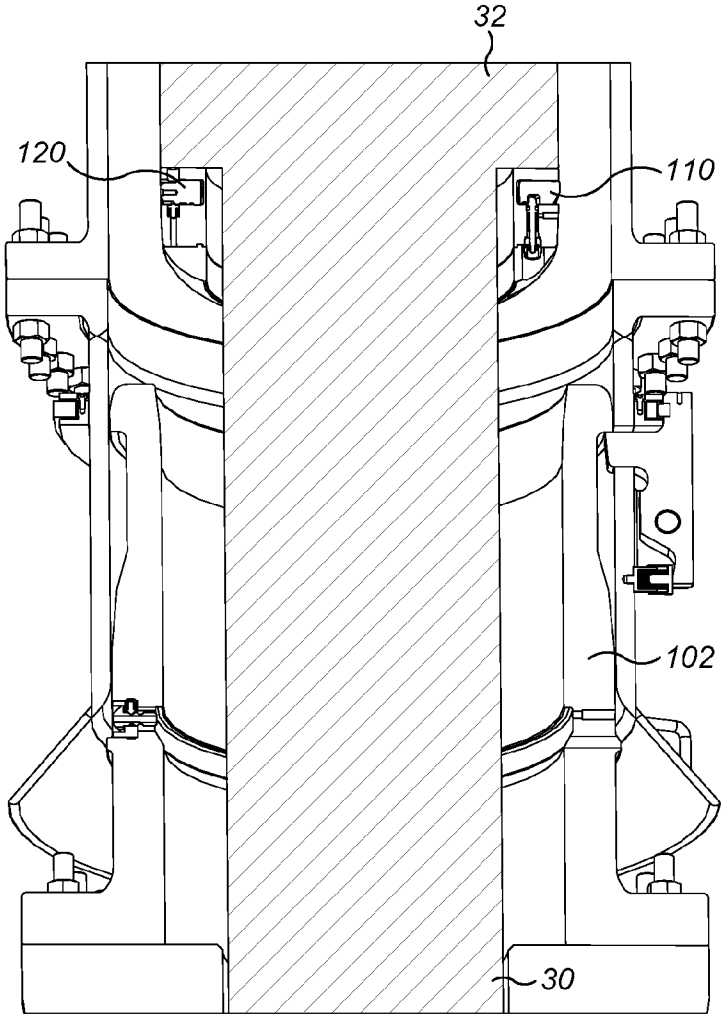
FIG. 11 shows a perspective sectional view of the connector assembly when the riser end-fitting is released and (a) moved through and out of the male connector assembly and (b) continues to be pulled through the 'I'-tube.
Figure 11A:
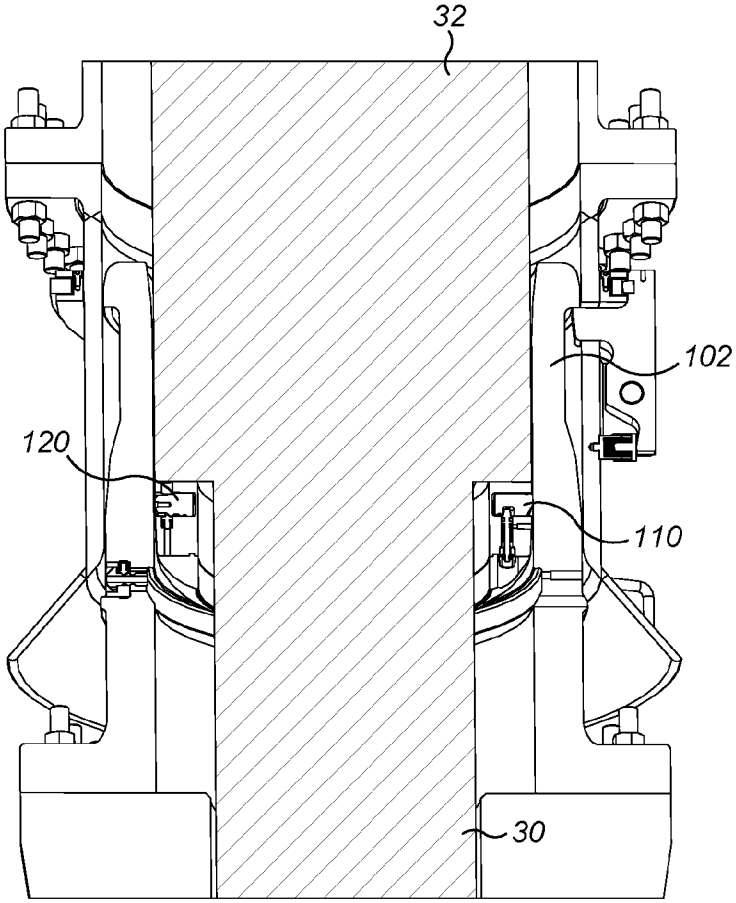
Figure 12A:
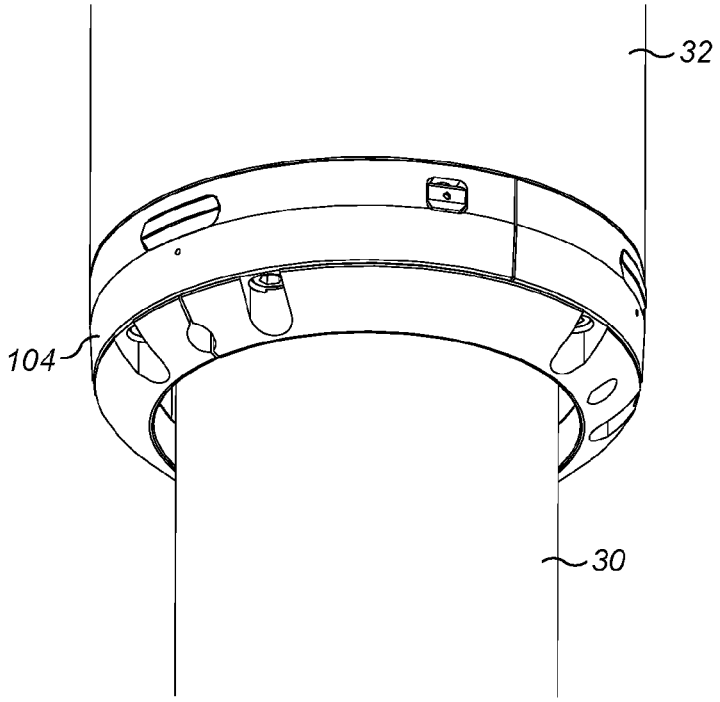
FIG. 12 shows a perspective view of a sequence (a)-(d) when removing the adapter assembly from the riser end-fitting for storage after the bend stiffener has been coupled to the 'I'-tube.
Figure 12B:
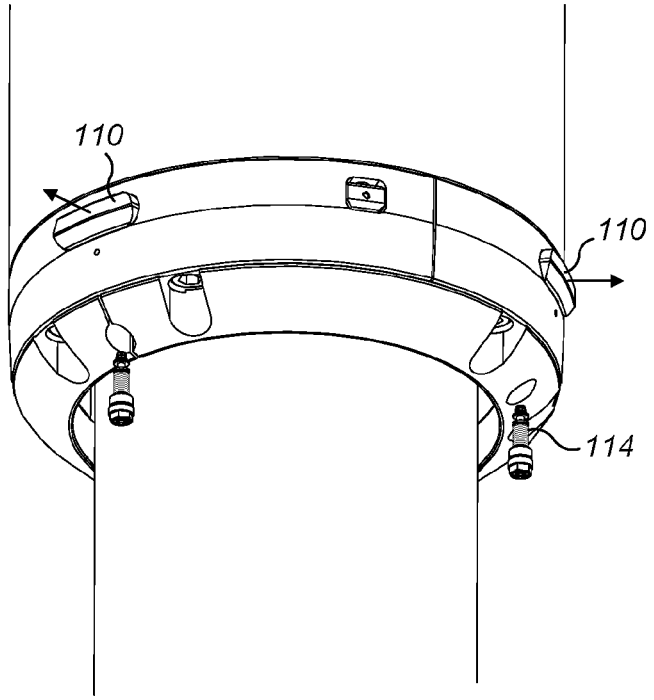
Figure 12C:
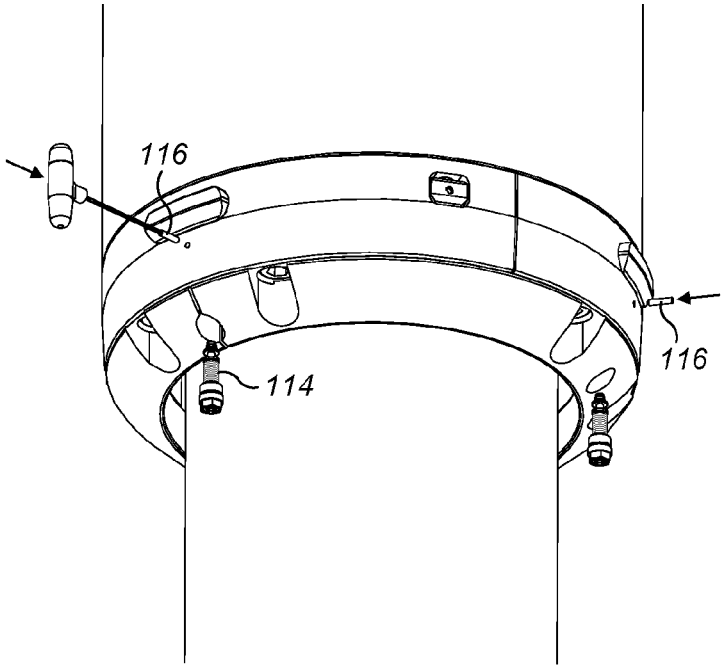
Figure 12D:
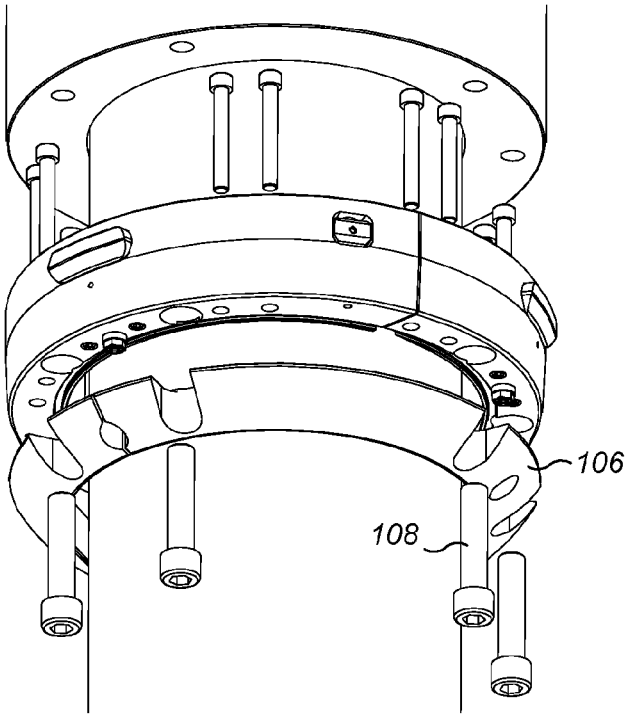
Figure 13B:
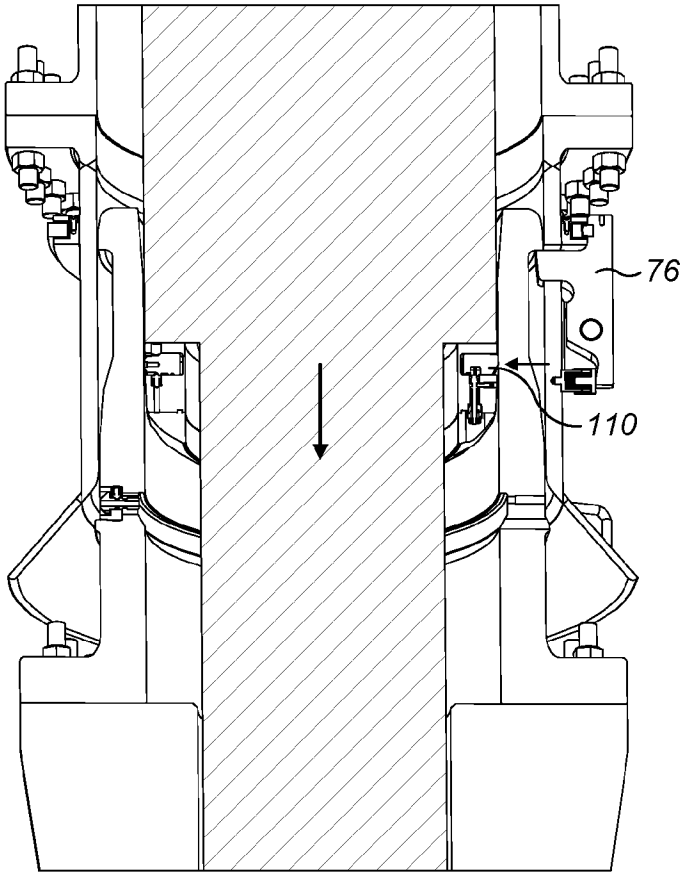
FIG. 13 shows a perspective sectional view of a sequence (a)-(d) when lowering the riser end-fitting and attached adapter assembly back into locked engagement with the male connector assembly.
Figure 13A:
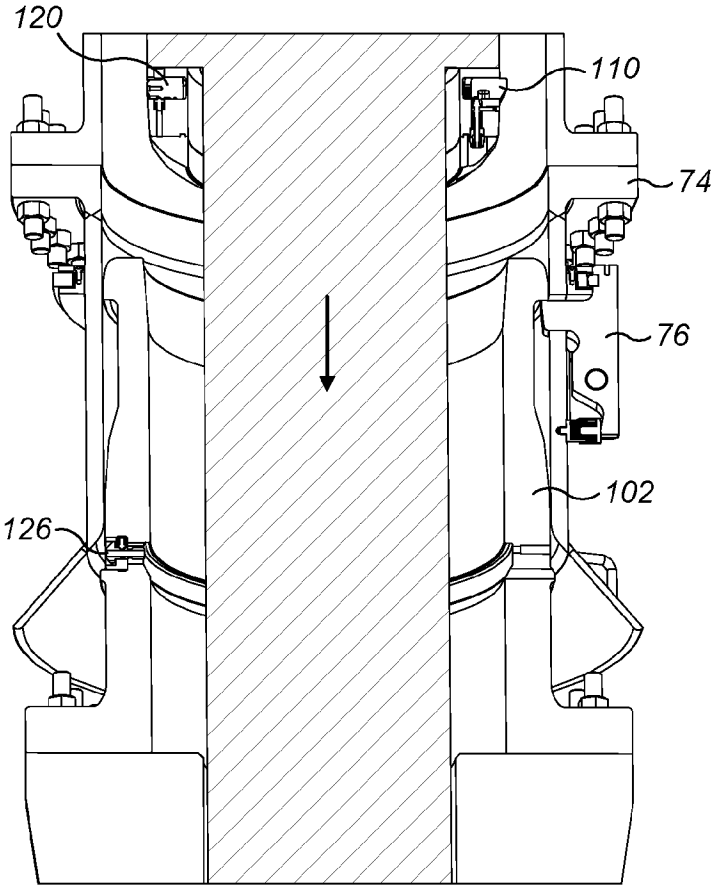
Figure 13D:
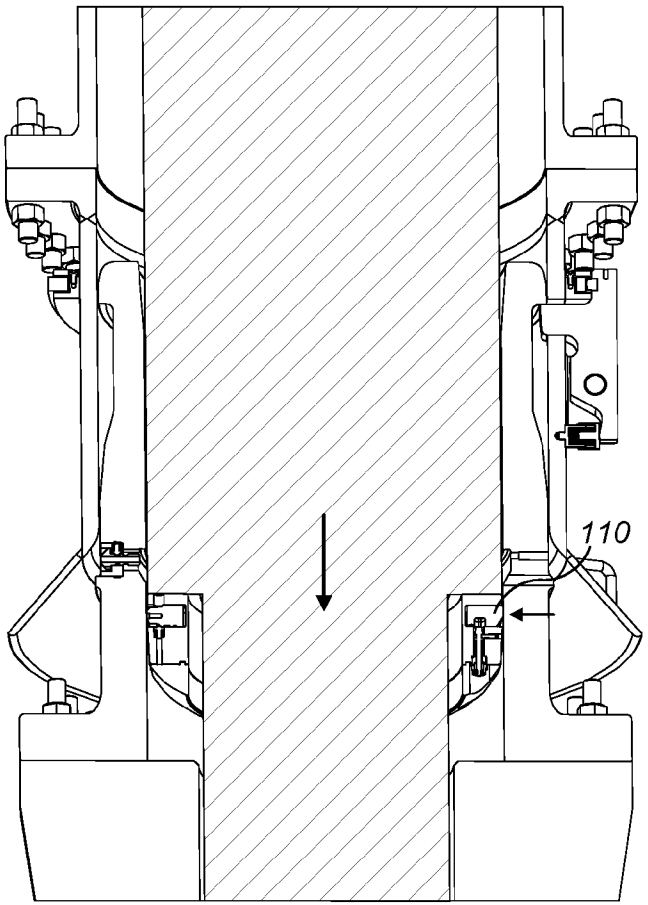
Figure 13C:
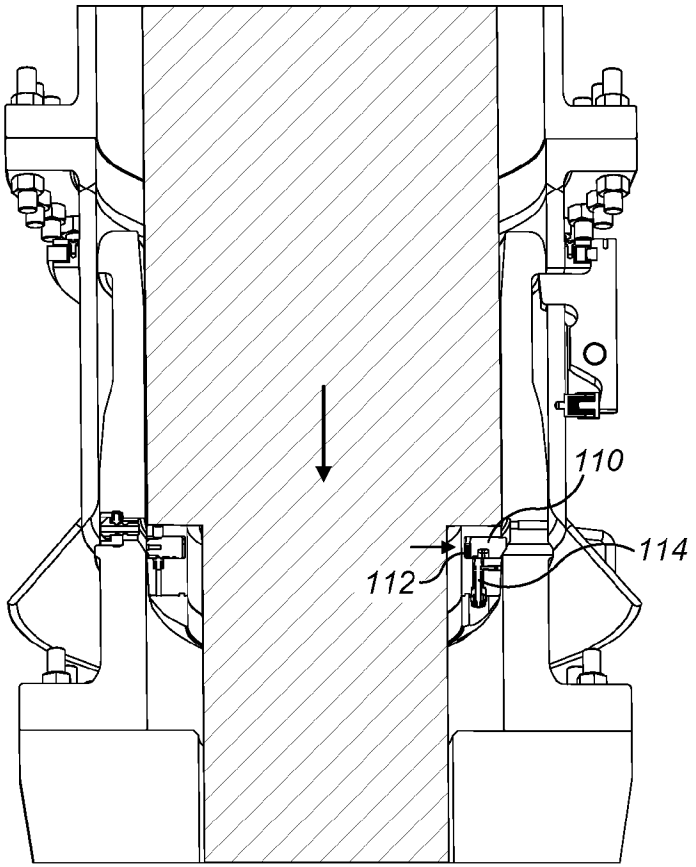
Figure 14B:
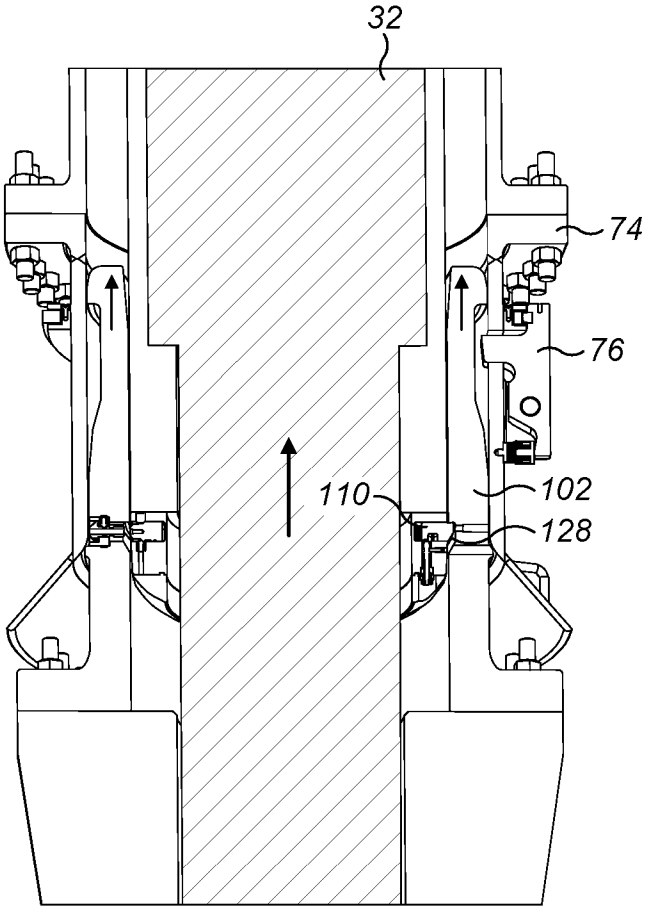
FIG. 14 shows a perspective sectional view of a sequence (a)-(d) when decoupling the male connector assembly (and attached bend stiffener) from the 'I'-tube and its attached female connector assembly.
Figure 14A:
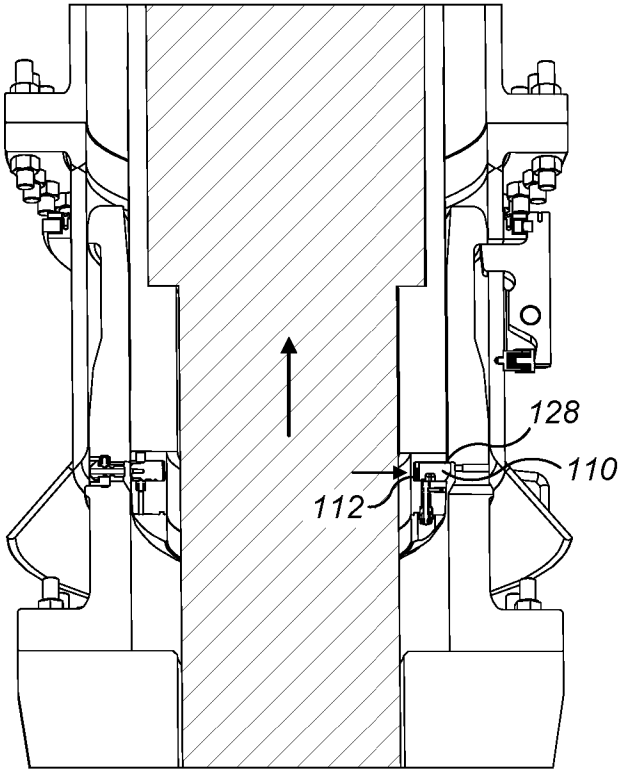
Figure 14D:
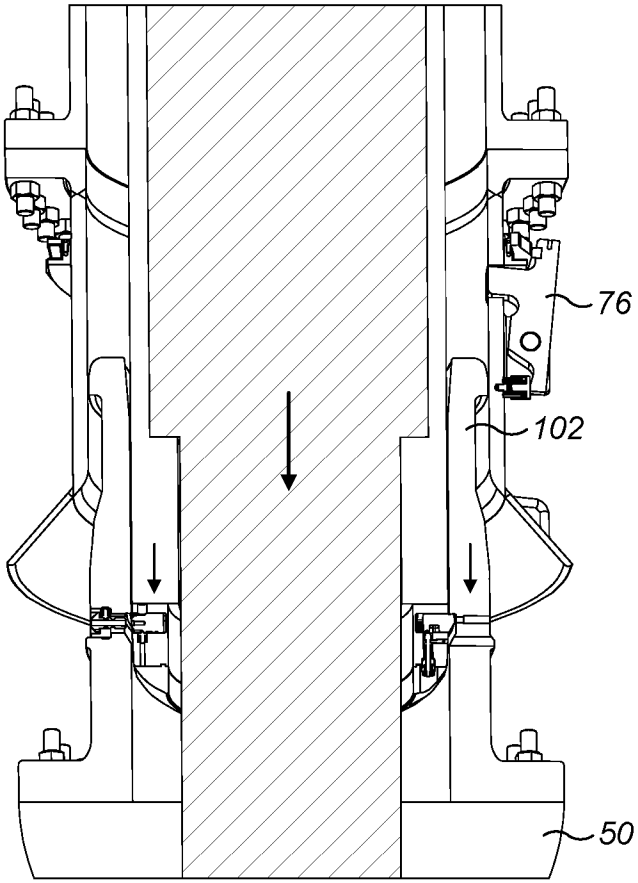
Figure 14C:
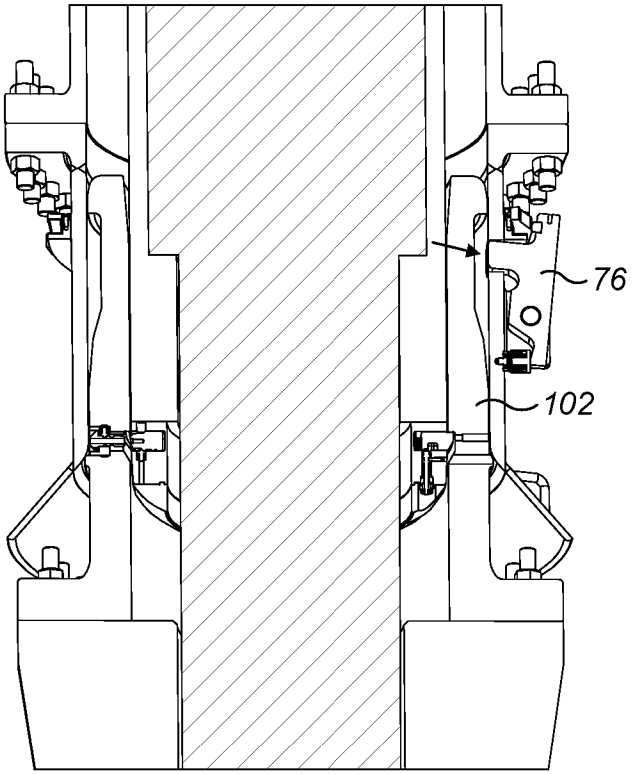

The riser end-fitting 32 and attached riser 30 are now detached from engagement with the male connector 102 and ready to be pulled up and through the 'I'-tube leaving the male connector 102 and attached bend stiffener 50 operatively mounted to the 'I'-tube without external intervention by, for example, a subsea diver or ROV. A sequence of pulling the riser end-fitting 32 through the male connector 102 is shown in FIGS. 11 (*a*) and (*b*).

Removal and Storage of End-Fitting Adapter

After installation of the bend stiffener 50, and once the riser 30 is connected to the FPSO 20, the adapter assembly 104 may be removed from the riser end-fitting 32 for storage until it may be used again for another installation or de-installation of a bend stiffener 50.

As shown in FIGS. 12 (*a*)-(*d*), the three complete locking pins 114 must be removed first to allow the primary collets 110 to return to their "active" first position. The three locking pins 114 are then replaced and disengagingly locked with the retaining grub screws 116. In particular, the locking pins 114 are first inserted but not screwed in until the retaining grub screws 116 are replaced to lock the locking pins 114 into place. The riser end-fitting adapter 104 is then removed by simply removing bolts 108 and ring mount 106.

It is understood by the person skilled in the art that in an alternative embodiment of the present invention, the adapter assembly 104 may be an integral part of the riser 30 and/or riser end-fitting 32, in which case it will not be removable for storage after completion of the installation.

Subsea De-Installation of a Bend Stiffener

Referring now to FIGS. 13 (*a*)-(*d*) and 14 (*a*)-(*d*), in order to utilize the present invention for intervention-less subsea de-installation of a bend stiffener 50, the previously stored adapter assembly 104 is reassembled and mounted to the bottom end of the riser end-fitting 32. In particular, locking pins 114 of the primary collets 110 are locked by retaining grub screw 116 so as to not engage with the primary collets 110. The primary collets 110 are thus slidable within recesses 118 and urged in a radially outward direction by biasing means, such as stacked conical washers 112. Secondary collets 120 are indexed and retained in their second position (i.e. retracted within recesses 122).

The prepared riser end-fitting 32 and attached riser 30 are then lowered into the throughbore 130 of the male connector 102 via 'I'-tube 60. When engaging with the inner wall of the female connector 74, the primary collets 110 are pushed back into the recesses 118 until engaging with the circumferential groove 128, where the primary collets 110. The riser end-fitting 32 is then lowered further so that the primary collets move back out of engagement with the groove 128 through the mating chamfered lower edges of the primary collets 120 and the groove 128. An optional shoulder (not shown) arranged within the throughbore 130 may stop the decent of the riser end-fitting 32 at a predetermined position.

As shown in FIGS. 14 (*a*)-(*d*), when the riser end-fitting 32 is moved back up, the biasing means 112 urge the primary collets 110 back into engagement with the groove 128 so as to attach the riser end-fitting 32 to the male connector 102. When continuing to move the riser end-fitting 32 upwards, the attached male connector 102 (and connected bend stiffener 50) is also moved upwards disengaging with the female latch 76. A female connector stop (not shown) may prevent the male connector 102 to be moved to far. The female latch 76 is then retracted and the riser end-fitting 32 with attached male connector 102 and bend stiffener 50 are released from the female connector 74, allowing the riser end-fitting 32, male connector 102 and bend stiffener 50 to be lowered as required.

The female latch 76 may be retracted manually by a subsea diver or ROV. However, in an alternative embodiment the female latch mechanism 76 may be adapted to be actuated by a suitable actuator (not shown) of the male connector when moving the riser end-fitting 32 and male connector 102 upwards within the throughbore 130.

Removal of the Riser End-Fitting from the Male Connector

Figure 15B:
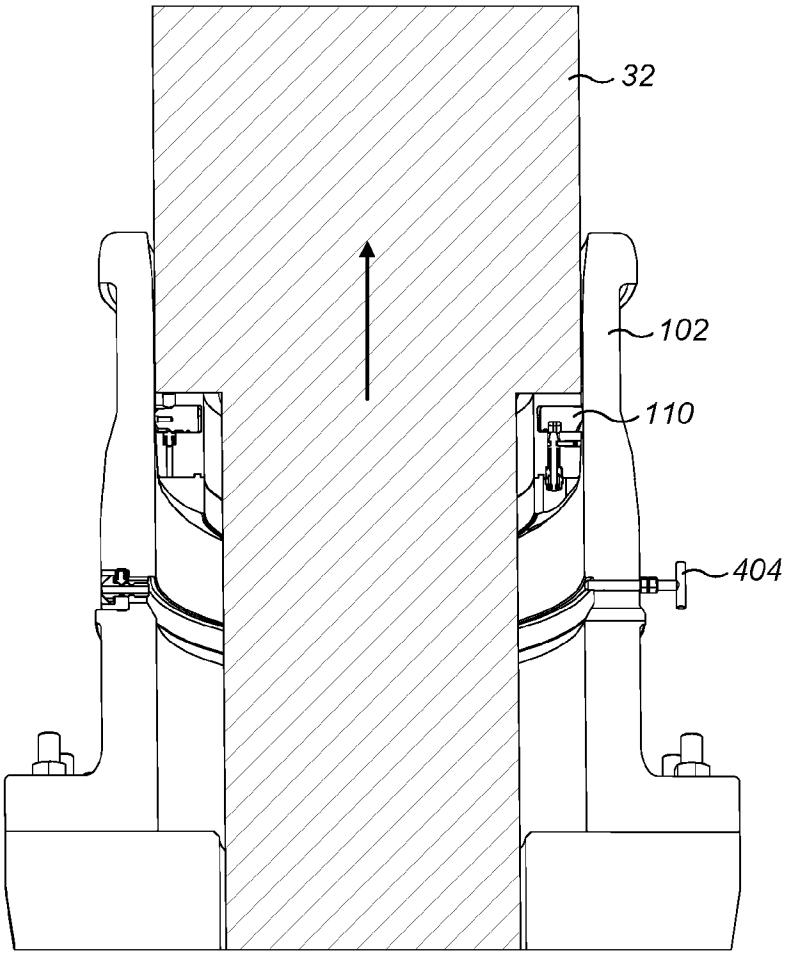
FIG. 15 shows a detailed perspective sectional view of the male connector assembly when (a) disengaging the first engagement member using the engagement member tool, and (b) retracting the riser end-fitting from the throughbore of the male connector assembly.
Figure 15A:
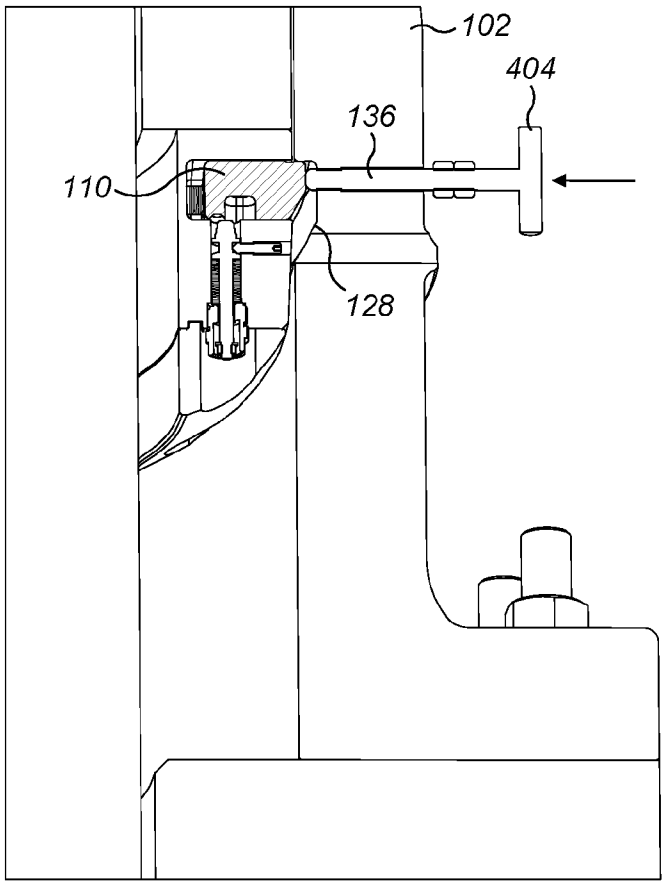

After completion of de-installation of the bend stiffener 50 from the 'I'-tube 60, the riser end-fitting 32 is removed out of engagement with the male connector 102, as shown in FIGS. 15 (*a*) and (*b*).

In particular and if required, the male connector 102 is rotated about the riser end-fitting 32 to align the primary collets 110 with tapped holes 136 situated in the male connector 102. A retraction tool 404 is inserted into the tapped holes 136 and screwed in to move the primary collets 110 back into their second "retracted" position. The male connector 102 may now be moved off the riser end-fitting 32.

It will be appreciated by persons skilled in the art that the above embodiment has been described by way of example only and not in any limitative sense, and that various alterations and modifications are possible without departing from the scope of the invention as defined by the appended claims.

The invention claimed is:

1. A subsea connector assembly for automatically coupling a movable subsea structure to a tubular fixed subsea structure, the subsea connector assembly comprising:

a male connector assembly, removably mountable to the movable subsea structure, comprising a throughbore, at least one first actuator member and at least one second actuator member;

an adapter assembly, removably mountable to an end-fitting of a string of tubulars of the tubular fixed subsea structure, comprising at least one first engagement member and at least one second engagement member, each of said at least one first engagement member and said second engagement member are operable to be acted upon by at least one of said first actuator member and said second actuator member so as to selectively release a locked engagement with said male connector assembly, allowing said adapter assembly to be moved through said throughbore of said male connector assembly; and wherein said first actuator member is a circumferential groove on an inner wall of said throughbore that is adapted to operatively engage with at least one of said at least one first engagement member and said at least one second engagement member.

2. The subsea connector assembly according to claim 1, wherein each of said at least one of said at least one first engagement member and said at least one second engagement member are operable to be acted upon by said at least one of said first actuator member and said second actuator member so as to selectively lock an unlocked engagement with said male connector assembly, allowing said adapter assembly to fixatingly engage with said male connector assembly.

3. The subsea connector assembly according to claim 1 , wherein said second actuator member is operable by matingly interlock said male connector assembly with a corresponding female connector.

4. The subsea connector assembly according to claim 1, wherein said circumferential groove is chamfered on its downhole side when in-situ.

5. The subsea connector assembly according to claim 1, wherein said at least one second actuator member is a pin slidingly arranged in an aperture through said male connector assembly, said aperture is positioned so as to coincide with said circumferential groove, allowing movement of said pin between a first pin position, where at least part of a proximal end portion of said pin projects out of said aperture past an outer male connector assembly wall, and a second pin position, where at least part of a distal end portion of said pin projects into said circumferential groove.

6. The subsea connector assembly according to claim 5, wherein said pin is adapted to be indexed in any one of said first and second pin position via a first indexing mechanism.

7. The subsea connector assembly according to claim 1, wherein said at least one first engagement member is arranged circumferentially about an outer surface of said adapter assembly.

8. The subsea connector assembly according to claim 1, wherein said at least one first engagement member is urged in a direction radially outwardly from said adapter assembly.

9. The subsea connector assembly according to claim 1, wherein said at least one first engagement member is adapted to move between a first engaged position, where said at least one first engagement member projects into said circumferential groove, and a first disengaged position, where said at least one first engagement member is moved out of engagement with said circumferential groove.

10. The subsea connector assembly according to claim 9, wherein said at least one first engagement member is adapted to be selectively locked in said first disengaged position via a second indexing mechanism.

11. The subsea connector assembly according to claim 10, wherein said second indexing mechanism is lockable in a retracted position so as to prevent any engagement with said at least one first engagement member.

12. The subsea connector assembly according to claim 9, wherein said at least one first engagement member is adapted to be indexed in said first engaged position.

13. The subsea connector assembly according to claim 1, wherein said male connector assembly comprises a plurality of at least one of circumferentially arranged first actuator members and second actuator members, and wherein said adapter assembly comprises a plurality of second engagement members operatively corresponding to said second actuator members.

14. The subsea connector assembly according to claim 1, wherein all of said second engagement members are circumferentially alignable with corresponding said second actuator members.

15. The subsea connector assembly according to claim 1, wherein said male connector assembly is adapted to matingly interlock with a corresponding female connector via a latch mechanism located on the corresponding female connector.

16. A subsea connector assembly for automatically coupling a movable subsea structure to a tubular fixed subsea structure, the subsea connector assembly comprising:

a male connector assembly, removably mountable to the movable subsea structure, comprising a throughbore, at least one first actuator member and at least one second actuator member;

an adapter assembly, removably mountable to an end-fitting of a string of tubulars of the tubular fixed subsea structure, comprising at least one first engagement member and at least one second engagement member, each of said at least one first engagement member and said second engagement member are operable to be acted upon by at least one of said first actuator member and said second actuator member so as to selectively release a locked engagement with said male connector assembly, allowing said adapter assembly to be moved through said throughbore of said male connector assembly; and wherein said at least one second engagement member is arranged coplanar with said at least one first engagement member, said second engagement member is adapted to move between a second engaged position, where said at least one second engagement member projects into the first actuator member, and a second disengaged position, where said at least one second engagement member is moved out of engagement with the first actuator member.

17. The subsea connector assembly according to claim 16, wherein said at least one second engagement member is adapted to be indexed in said second engaged position and said second disengaged position via a third indexing mechanism.

* * * * *